US006418987B1

(12) United States Patent
Colasacco

(10) Patent No.: US 6,418,987 B1
(45) Date of Patent: Jul. 16, 2002

(54) FLUID RECOVERY CAP SYSTEM

(76) Inventor: Rocco Colasacco, 28039 N. 77th St., Scottsdale, AZ (US) 85255

( * ) Notice: Subject to any disclaimer, the term of this patent is extended or adjusted under 35 U.S.C. 154(b) by 0 days.

(21) Appl. No.: 09/844,918

(22) Filed: Apr. 27, 2001

(51) Int. Cl.[7] ..... B65B 1/04; B65B 3/00; B67C 3/00

(52) U.S. Cl. ..... 141/384; 141/319; 141/348; 141/363; 141/364; 141/366

(58) Field of Search ..... 141/346, 319, 141/351–355, 363–366, 348, 384

(56) References Cited

U.S. PATENT DOCUMENTS 3,620,267 A 11/1971 Seablom
4,105,142 A 8/1978 Morris
4,356,848 A * 11/1982 Spies ..... 141/349
5,285,824 A 2/1994 Krstovic
5,641,012 A 6/1997 Silversides
5,642,763 A 7/1997 Kurtz
5,655,580 A 8/1997 Schrock
5,918,650 A 7/1999 Borden
5,947,171 A * 9/1999 Woodruff ..... 141/346
6,105,639 A 8/2000 Murphy

* cited by examiner

*Primary Examiner*—Timothy L. Maust
(74) *Attorney, Agent, or Firm*—LaValle D. Ptak

(57) ABSTRACT

A fluid recovery system for removing fluid from a first container into a second container is formed from a dual cap system. The first of the caps has a push-pull, pop-up valve dispenser in it. A second inverted cap is placed between the actuator for the push-pull valve and the top of the first cap. The second cap has a circular opening cut out at its center which loosely fits around a cylindrical extension of the pop-up valve on the first cap. When the device is to be used, the push-pull valve actuator is pressed closed and the first cap is threaded onto the empty container. The entire assembly then is inverted; and the second cap is threaded onto the container which is to receive the residue from the "empty" container. After the two caps have been threaded onto the respective containers, they are pulled a short distance apart to cause the push-pull valve actuator to be opened; and the top container then empties into the lower container. Air escapes through the loose fitting between the hole in the top of the second cap and the cylindrical extension on the first cap.

11 Claims, 3 Drawing Sheets

FLUID RECOVERY CAP SYSTEM

BACKGROUND

Bottles typically made of glass or plastic are used for the storage of fluids of many different types. These bottles or similar containers often have threaded caps or pop-up valve dispensing caps releasably secured to their necks, over the openings, to permit the removal of some or all of the fluid, followed by reclosure of the bottle or container. When the bottle or container is emptied, usually it is disposed of, ultimately ending up in a landfill.

Often, it is desirable to transfer the remains of the contents of one bottle or container of fluid to another. This is particularly true of containers for viscous fluids such as motor oils, shampoo, ketchup, syrup, cooking oil, etc. When a container holding any of these various types of viscous fluids is "emptied", a considerable residue of fluid still adheres to the walls and bottom of the container. Generally, the container is disposed of with this viscous fluid still clinging to its interior. The amount of viscous fluid remaining in a so-called "empty" container is not insignificant. In a typical quart bottle of motor oil, approximately one ounce of motor oil remains in the container after it has been emptied into a vehicle. Since ketchup and syrup typically are sold in transparent containers, the amount of residue remaining in the bottle after it effectively has been emptied is readily apparent to the naked eye.

Very often, in the case of ketchup or other similar viscous food products, a home owner or restaurant owner places the open end of the "empty" bottle over the top of a full or nearly full bottle to transfer the contents from the empty bottle into the receiving bottle. Because the ketchup or syrup (or motor oil, or shampoo) is highly viscous, the flow from one bottle to the next is very slow. In addition, a very careful balancing act is required; or a person needs to hold the two bottles together for a considerable period of time to transfer the contents of one to the other.

Attempts have been made in the past to facilitate the transfer of a viscous fluid from one bottle to another by means of some type of coupler interconnecting the two bottles. One such device is disclosed in the United States patent to Seablom U.S. Pat. No. 3,620,267. The device of this patent is designed to interconnect two ketchup bottles together. It simply comprises a sleeve, open at both ends, for receiving the tops of the upper and lower ketchup bottles. It has an expansion chamber in its center to allow air bubbles to flow upward through the downward flow of ketchup into the upper bottle as the ketchup residue flows from the upper bottle into the lower one. There is no valve in this coupler; it is simply placed over both ends of the bottles to hold them together while the upper one empties into the lower one.

The device of United States patent to Crstovic U.S. Pat. No. 5,285,824 is designed to remove oil from a catch pan and allow it to be poured into a container for subsequent disposal. A nozzle on the catch pan is interconnected with the top of the receiving container by means of a coupler, which is threaded onto both the pan and the container to interconnect them while the catch pan is poured into the receiving container. Again, no valve is used.

A different approach is disclosed in the patent to Borden U.S. Pat. No. 5,918,650. This patent utilizes a two part coupler. The coupler for the upper "empty" container is in the form of a generally truncated, cone-shaped male end extending from the cap. A mating receiving funnel is threaded onto the lower receiving container; and the truncated cone-shaped projection on the upper container is pressed into the receiving funnel on the lower container to allow fluid to flow from the upper to the lower container. There is nothing in the device of this patent in the form of a valve, or for providing for air release from the lower container during the transfer of fluids.

The United States patent to Kurtz U.S. Pat. No. 5,642,763 is directed to a two-ended coupler for threading onto open matingly threaded ends of a pair of containers, such as oil containers. The coupler itself is formed with an internal funnel, with a drip guide on its lower or dispensing end, to prevent liquid draining from the inverted first container from running between the connection of the coupler with the lower container and the threads on the neck of the lower container. The drip guide is intended to cause the fluid flowing from the upper container to drip in a generally central location into the neck of the lower container. Once again, there is no provision for allowing air to escape from the lower container into the upper container, or elsewhere, and there is no valve between the two containers in the device of this patent.

The United States patent to Schrock U.S. Pat. No. 5,655,580 comprises an interconnected funnel and spout which are connected, by means of a double clamp, onto a lower and upper bottle, respectively, to allow the fluid in the upper bottle to flow through the spout into the funnel, and from there into the lower bottle. No valves are used in this device; but it does allow for the transfer of fluid from an upper container to a lower container, without requiring a person to hold the two containers in position while the transfer takes place.

Two other United States patents, to Murphy U.S. Pat. No. 6,105,639 and Silversides U.S. Pat. No. 5,641,012, are directed to relatively complex mechanisms including a valve for coupling an upper container into a lower one, and then controlling the flow of fluid between them. The coupler is airtight between the two different containers; so that air exiting the lower container as fluid is transferred into it necessarily periodically needs to bubble upwardly through the fluid being transferred from the upper container into the lower one. Murphy employs a downwardly depending conical shape of the opening into the lower container to minimize the flow of fluid outwardly toward the edge of the container during transfer. In the device of Murphy, a valve is opened by pulling the two containers apart when the caps are attached to both of them; and the valve is closed by pushing them together.

The patent of Silversides discloses a relatively complex valve mechanism for a customized application. There is no air release; so that air bubble transfer must take place from the lower container into the upper one.

The United States patent to Morris U.S. Pat. No. 4,105,142 includes threaded cap portions for attachment to each of an upper and a lower container for allowing transfer of fluid from the upper container into the lower one. The device of Morris, however, has a collapsible section between the two end caps, and requires a person to hold the containers apart to open a valve to allow fluid to flow from the upper container to the lower one. If the two containers are not held apart, the collapsible section collapses to close the valve. It also should be noted that the device of this patent requires a custom cooperating construction between the coupling device and the container being filled, since the female portion of the valve is built into the container; whereas the male portion is in the coupling.

It is desirable to provide an improved fluid recovering system for allowing the transfer of fluids, particularly viscous fluids, from one container to another by means of a simple, easily activated valve mechanism in a coupling device holding the two containers together.

SUMMARY OF THE INVENTION

It is an object of this invention to provide an improved fluid recovery system.

It is another object of this invention to provide an improved easy-to-use, fluid recovery device for transferring fluid from one container to another.

It is an additional object of this invention to provide an improved fluid recovery device for transferring viscous fluids from one container to another.

It is a further object of this invention to provide a device for transferring fluids from one container to another utilizing a simple valve mechanism between a pair of loosely joined caps to couple the container which is to be emptied onto the container which is to receive the fluid.

In accordance with a preferred embodiment of the invention, a fluid recovery system is designed in the form of a pair of interconnected first and second caps. The first cap is attached to the upper container; and it has an aperture through its top, with a valve located in the aperture. The second cap is loosely held onto the first cap by the valve actuator, and is designed for attachment to the receiving container; so that when the valve actuator is opened, fluid flows from the upper container into the lower container.

DETAILED DESCRIPTION

Figure 1:
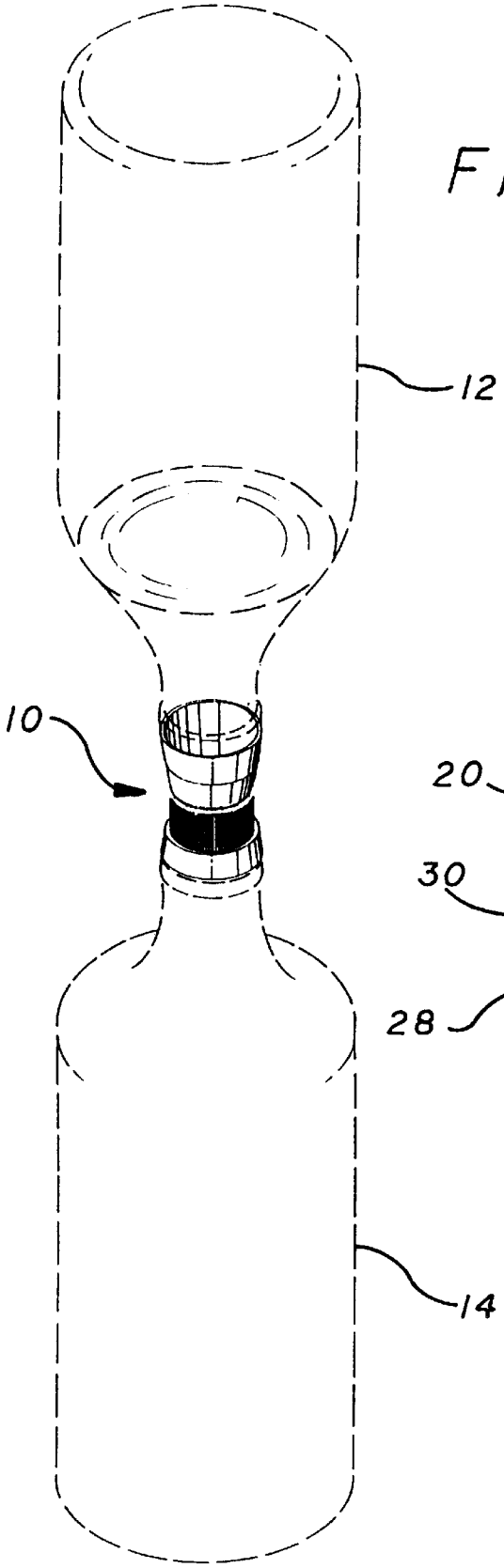
FIG. 1 is a diagrammatic representation of a preferred embodiment of the invention showing its position of use.

Reference now should be made to the drawings, in which the same reference numbers are used throughout the different figures to designate the same or similar components. The fluid recovery system or fluid recovery device of a preferred embodiment of the invention is illustrated in the diagrammatic representation of FIG. 1. The device 10 includes a pair of back-to-back loosely interconnected caps 16 and 28, which are threaded onto or otherwise secured to the mating threads on the necks of a pair of containers 12 and 14. Typically, the container 12 is one which has been essentially emptied of its contents. In the case of viscous fluids, however, a considerable amount of fluid remains on the walls and bottom of an empty container after its contents have been removed. Recovery of viscous fluid which adheres to the walls and bottom of the container 12 after it has been emptied, generally is a time consuming task. A sufficient amount of fluid remains in such an empty container, however, to justify the removal of this fluid by allowing it to flow out of the container over a prolonged period of time, such as overnight or for twelve to 24 hours. This time typically is sufficient to allow transfer of most viscous fluids out of the "empty" container, if it is held in its inverted position to permit the fluid slowly to flow out through the open neck of the container.

The device 10 is used to couple an empty container 12 in its inverted position and allow fluid in it to flow through the coupling device 10 into a mating container 14, which either may be a container into which a number of "empty" containers 12 are sequentially coupled, or it may be a nearly full container having the same contents as the container 12.

Figure 4:
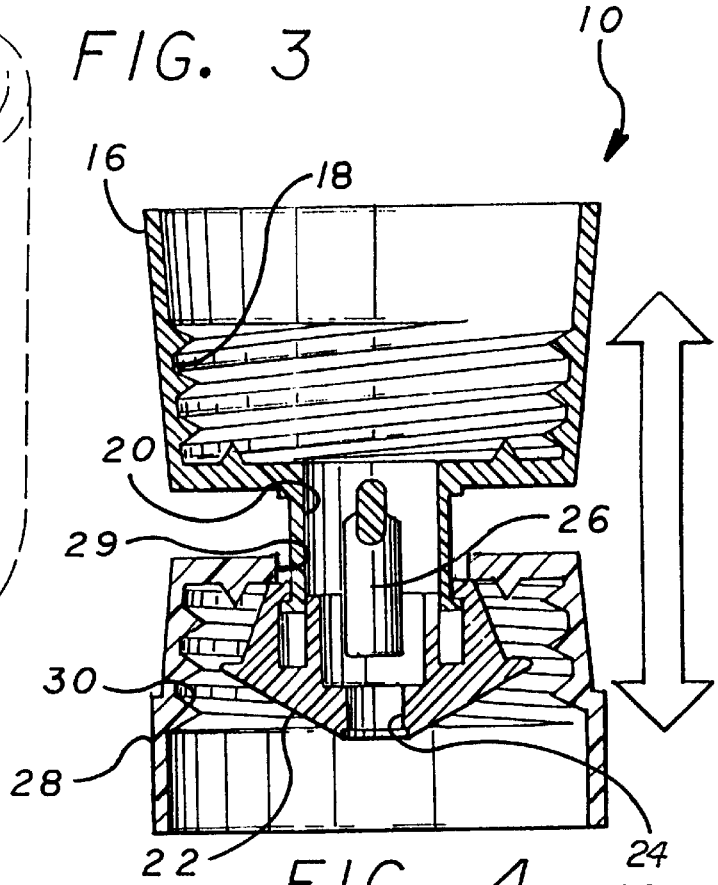
FIG. 4 is a cross-sectional view of the preferred embodiment of the invention showing an operating feature.
Figure 5:
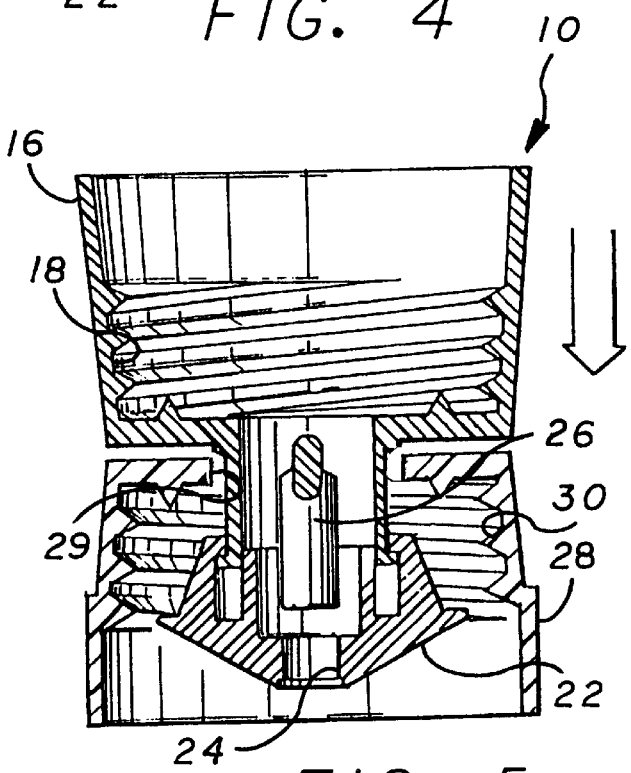
FIG. 5 is another cross-sectional view of a preferred embodiment of the invention showing the positions of the various parts during fluid transfer.
Figure 6:
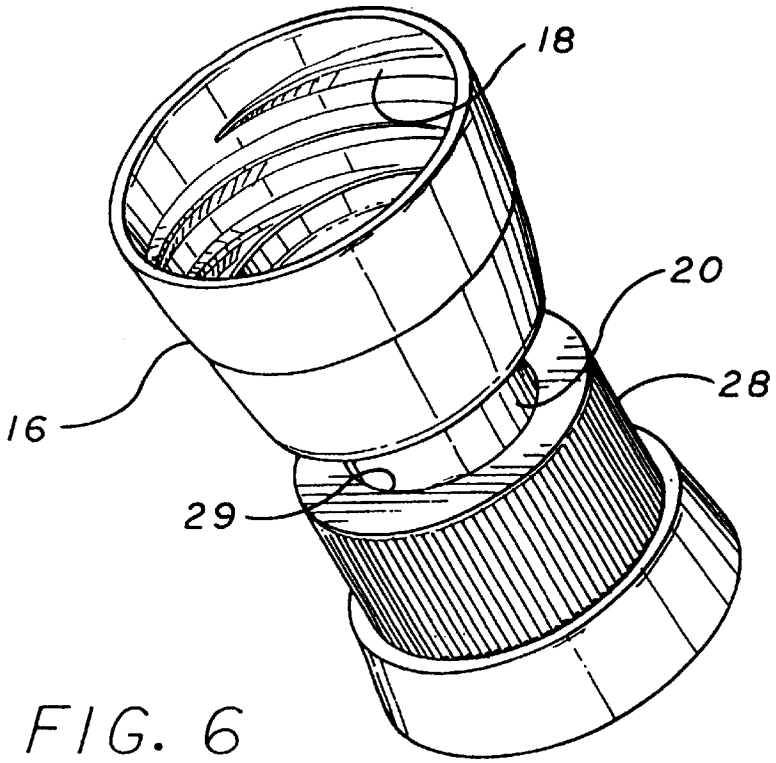
FIG. 6 is a top perspective view of the preferred embodiment of the invention.
Figure 7:
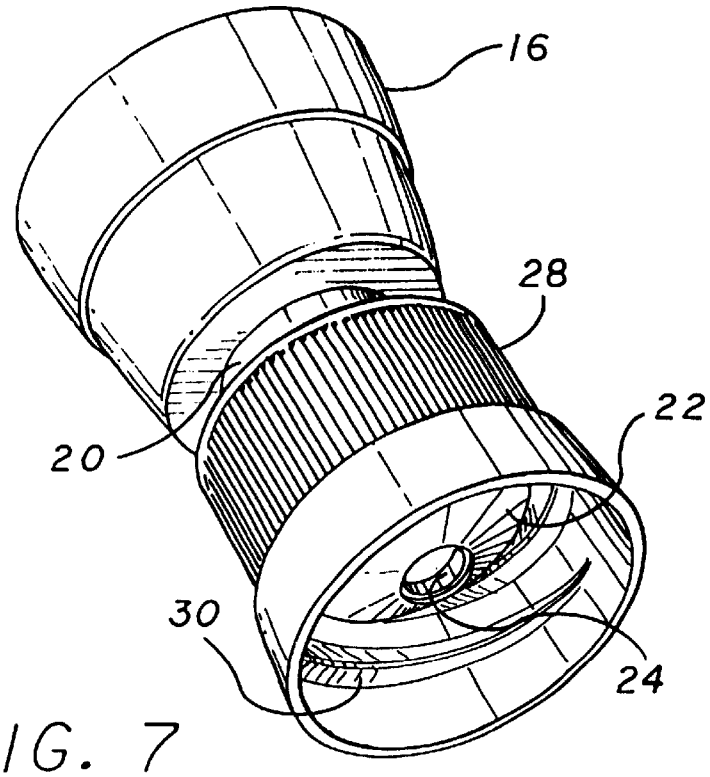
FIG. 7 is a bottom perspective view of the preferred embodiment of the invention.

The remainder of the description of the preferred embodiment of the invention now is made in conjunction with FIGS. 3 through 7. FIGS. 6 and 7 are a top perspective view and a bottom perspective view, respectively, of the fluid recovery device 10. As shown in these figures, the fluid recovery device includes an upper cap 16, which is internally threaded at 18 to fit onto the particular type of container with which the device is to be used. A relatively small number of externally threaded necks are formed on bottles or containers for a wide variety of products. The necks of some containers, however, are larger than others; so for different applications, the actual dimensions of the dual cap device 10 need to be configured to fit the particular application with which the device is to be used. For any given use, however, the upper cap 16 and the lower cap 28 are designed with internally threaded portions 18 and 30, respectively, of the same dimensions, since the object generally is to transfer fluid from one container into another container of the same type.

The upper cap 16 ideally is of the type widely used with a push-pull valve in it, of the type commonly used for dispensing water, syrup, mustard and other fluids (both free-flowing and relatively highly viscous) from a container. Such a valve is shown in the cross-sectional views of FIGS. 2, 4 and 5; and since the valve is in widespread common use, only the general characteristics of the valve are shown and described here. Its operation is well known.

Figure 2:
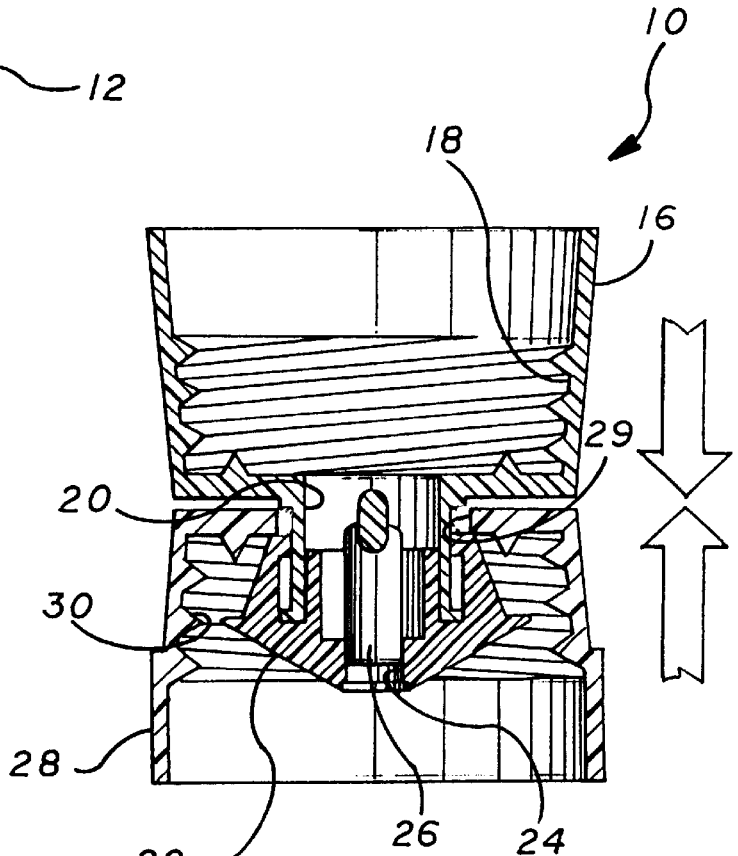
FIG. 2 is a cross-sectional view of a preferred embodiment of the invention in its closed position.
Figure 3:
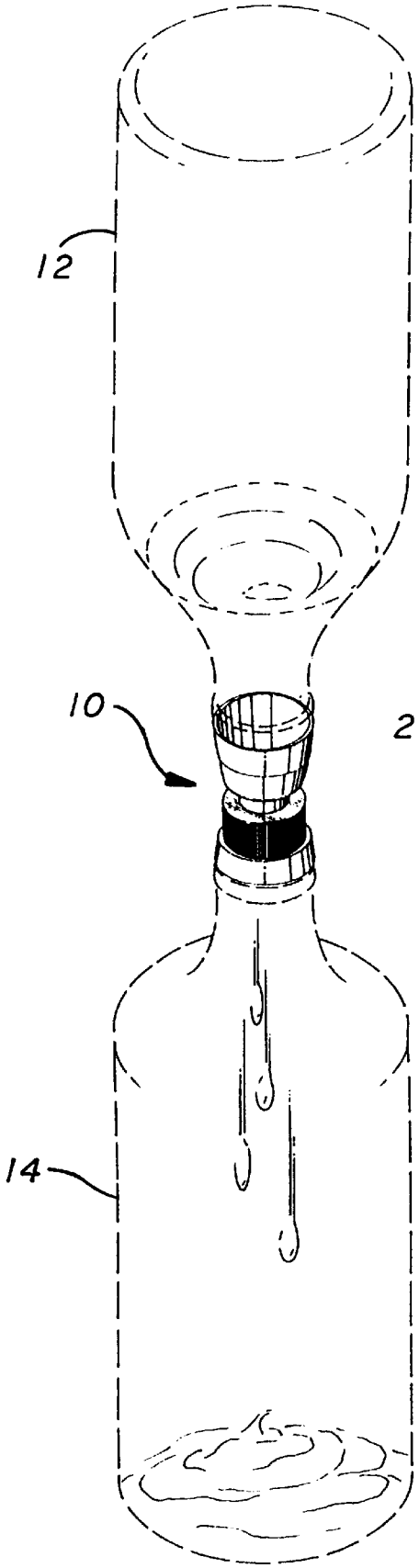
FIG. 3 is a diagrammatic representation of the preferred embodiment of the invention illustrating its position during fluid transfer.

The cap 16 has a top with an axial passage 20 through it, in the form of a cylindrical spout extending from the center of the top of the cap. The push-pull valve operating mechanism 22 then is mounted on this cylindrical extension 20 for reciprocal movement toward and away from the cap 16 to close and open, respectively, a passageway 24 through the actuator 22 of the valve. FIG. 2 shows the valve in its closed position, where a plug 26, held in place in a centered location in the hollow cylindrical extension 20, fits into and seals off a circular opening 24 in the push-pull valve actuator 22.

The cap 28, which is to be threaded onto the lower container by means of the internal threads 30, is of a standard configuration, except that it has a circular hole 29 located in the center of its top. The hole 29 is designed to loosely fit over the exterior of the cylindrical section 20, as is clearly shown in all of FIGS. 2, 4 and 5. As is readily apparent from an examination particularly of FIGS. 2, 4 and 5, the device essentially consists of three parts, namely the caps 16 and 28 and the push-pull valve actuator 22.

To assemble the device, the cylindrical extension 20 first is inserted through the opening 29 in the cap 28. Then the valve actuator 22 is placed over the extension 20 and popped into place to assemble it onto the extension 20 in a conventional manner. It should be noted, however, that the external dimensions of the valve actuator 22 are such that it is larger than the circular opening 29 through the cap 28. Thus, the cap 28 is loosely held in place by the valve actuator 22 when the two caps 16 and 28 are assembled together with the valve actuator 22 between them, as illustrated in FIGS. 2, 4, 5, 6 and 7. This construction creates an air space between the circular hole 29 and the outside of the cylindrical extension 20 to allow air passage through this opening and out through the space between the generally flat top surfaces of the caps 16 and 28 into the ambient atmosphere when the device is in use. This is explained in greater detail subsequently.

To use the fluid recovery system or device, the upper cap 16 (as illustrated in FIGS. 2, 4, 5, 6 and 7) first is threaded onto the open neck of the container 12 which is to be emptied into the container 14. The pop-up valve 22 is closed to the position shown in FIG. 2 where the plug 26 closes the hole 24. The empty container 12 then is inverted to the position shown in FIGS. 1 and 3; and the lower cap 28 is threaded by means of the threads 30 onto the open neck of the lower container 14, into which the fluid is to be delivered. After the two caps 16 and 28 have been threaded onto the respective containers 12 and 14, the caps are pulled apart as shown in FIG. 4 by pulling the container upwardly with respect to the container 14. This causes the pop-up valve to be opened by relatively moving the valve actuator 22 downwardly (as viewed in FIG. 4) away from the plug 26; so that the opening 24 now has a clear communication through the cylinder extension 20 and the open interior of the cap 16 with the contents of the container 12.

After the caps have been pulled apart as shown in FIG. 4, the upper container is allowed to drop downwardly; so that the top or flat surface of the inverted upper cap 16 rests on the top or flat surface of the lower cap 28, as shown in FIG. 5, with the cylinder 20 extending through the hole 29 in the top of the cap 28 and the valve actuator 22 projecting downwardly into the neck of the lower container 14 to allow fluid to flow from the upper container 12 into the lower container 14, as diagrammatically illustrated in FIG. 2.

It should be noted that the pop-up valve actuator 22, with the generally conical taper on its inverted surface as shown in FIGS. 4 and 5, allows the fluid to flow directly into the neck of the lower container 14 and prevents fluid from flowing outwardly into the area around the threads 30, which secure the cap 28 to the neck of the lower container 14. In addition, the air space provided by the difference in dimensions between the diameter of the circular hole 29 in the top of the cap 28 and the exterior diameter of the cylindrical extension 20 on the upper cap 16 provides a free outward passage for air being displaced from the bottom container 14 by the fluid flowing into it, without any bubbling of air up through the fluid flowing from the upper container through the interior of the cylindrical extension 20 and out through the hole 24. This is particularly significant in the case of highly viscous fluid such as ketchup, since no air pressure builds up in the lower bottle to prevent the free flow of the highly viscous fluid through the opening 24 in the valve actuator 22. There is no need for any O-rings or sealant between the two containers, since all of the fluid from the upper container 12 flows through the small hole 24 in the pop-up or valve actuator portion 22 used in conjunction with the upper cap 16.

Once a container 12 has been fully emptied into the lower container 14 (and typically, an overnight time frame may be employed), the caps may be unthreaded from the two containers and cleaned, if desired, ready for a new use. When they are to be used again, the valve actuator 22 is pressed or popped into the position shown in FIG. 2; and the above sequence is repeated. By utilizing a valve, it is a simple task to first attach the fluid transfer device to the container 12 when it is in its upright position and then invert it, without spilling any fluid, while the lower cap 28 is threaded onto the neck of the receiving container 14. Only when both portions of the device are secured to the respective containers, is the operation which is illustrated in FIG. 4 effected to open the passageway between the containers to allow the commencement of the fluid transfer between the containers to take place.

Clearly, threaded caps 16 and 28 of different thread diameters may be used to transfer fluid from a container of one size to a container of a different size if such a system is desired. Threaded caps having different diameters may be used for different types of containers.

The foregoing description of the preferred embodiment of the invention is to be considered illustrative and not as limiting. Various changes and modifications will occur to those skilled in the art for performing substantially the same function, in substantially the same way, to achieve substantially the same result, without departing from the true scope of the invention as defined in the appended claims.

What is claimed is:

1. A recovery cap system for use in facilitating the emptying of one container into another including in combination:

a first cap having a top with an opening through it designed to removably fit onto a first container;

a valve in the first cap for selectively opening and closing the opening through the first cap;

a second cap having a top with an opening through it designed to removably fit onto a second container;

a hollow cylindrical extension on the top of the first cap and surrounding the opening through the first cap, with the extension on the first cap passing through the opening in the second cap;

a valve actuator secured in the cylindrical extension on the first cap for limited axial movement relative to the cylindrical extension, with the valve actuator closing the valve in one position of movement thereof and opening the valve in a second axially displaced position of movement thereof; and means for loosely securing the second cap to the first cap with the openings through the first and second caps in alignment with one another.

2. The recovery cap system according to claim 1 wherein the valve actuator extends through the opening in the second cap to loosely secure the second cap to the first cap of the recovery cap system.

3. A recovery cap system according to claim 1 wherein the opening in the first cap is a circular opening and the cylindrical extension is axially aligned with and extends from the circular opening in the first cap, and the opening through the top of the second cap is a circular hole having an internal diameter greater than the external diameter of the cylindrical extension on the top of the first cap to allow the cylindrical extension of the first cap to extend through the circular hole in the second cap.

4. A fluid recovery system for removing fluid from a first container into a second container, the system including in combination:

a first cap designed to be removably secured onto an open neck of a first container from which fluid is to be removed, the first cap having an axial passage therethrough opening into a hollow cylindrical portion extending outwardly from the axial passage;

a second cap designed to removably fit onto an open neck of a second container into which fluid is to be placed, the second cap having a top with a hole through it; and a push-pull valve actuator extending through the hole in the second cap and having a flange on it wider than the hole in the second cap to engage the second cap in the area around the hole, the push-pull valve actuator mounted on the hollow cylindrical portion of the first cap to selectively open and close the axial passage through the first cap and the hollow cylindrical portion.

5. A fluid recovery system according to claim 4 wherein the first and second caps are loosely axially aligned with and retained together by the push-pull valve actuator.

6. The fluid recovery system according to claim 5 wherein the push-pull valve actuator has an axial opening through it, and the hollow cylindrical portion of the first cap has a plug in it, such that when the valve actuator is pushed toward the first cap, the plug fits into the axial opening in the valve actuator to close the aperture, and when the valve actuator is pulled a predetermined distance away from the first cap, the axial opening in the actuator moves away from the plug in the cylindrical portion to allow fluid flow through the axial opening in the valve actuator.

7. The fluid recovery system according to claim 6 wherein the first and second caps each are internally threaded to fit onto external threads on the necks of the first and second containers, respectively.

8. The fluid recovery system according to claim 4 wherein the push-pull valve actuator has an axial opening through it, and the hollow cylindrical portion of the first cap has a plug in it, such that when the valve actuator is pushed toward the first cap, the plug fits into the axial opening in the valve actuator to close the aperture, and when the valve actuator is pulled a predetermined distance away from the first cap, the axial opening in the actuator moves away from the plug in the cylindrical portion to allow fluid flow through the axial opening in the valve actuator.

9. The fluid recovery system according to claim 4 wherein the first and second caps eac are internally threaded to fit onto external threads on the necks of the first and second containers, respectively.

10. A fluid recovery system according to claim 9 wherein the first and second caps are loosely axially aligned with and retained together by the push-pull valve actuator.

11. The fluid recovery system according to claim 4 wherein the hole in the second cap loosely fits around the push-pull valve actuator to permit the passage of air therethrough.

* * * * *